US005892429A

United States Patent [19]

Hofsäss

[11] Patent Number: 5,892,429

[45] Date of Patent: Apr. 6, 1999

[54] SWITCH HAVING A TEMPERATURE-DEPENDENT SWITCHING MECHANISM

[76] Inventor: Marcel Hofsäss, Höfener Strasse 29, 75305 Neuenbürg, Germany

[21] Appl. No.: 792,255

[22] Filed: Jan. 31, 1997

[30] Foreign Application Priority Data

Feb. 10, 1996 [DE] Germany ..... 196 04 939.3

[51] Int. Cl.[6] ..... H01H 37/14

[52] U.S. Cl. ..... 337/377; 337/102; 337/107; 361/26; 361/105

[58] Field of Search ..... 337/23–27, 29, 337/102–107, 333, 334, 335, 377, 343, 348, 365, 379, 380; 361/23–25, 27, 103, 105, 106, 32

[56] References Cited

U.S. PATENT DOCUMENTS

| | | | |
|---|---|---|---|
| 4,849,729 | 7/1989 | Hofsass | 337/102 |
| 4,862,132 | 8/1989 | Hollweek | 337/102 |
| 5,023,744 | 6/1991 | Hofsass | 361/26 |
| 5,615,072 | 3/1997 | Hofsass et al. | 361/24 |

FOREIGN PATENT DOCUMENTS

| | | |
|---|---|---|
| 2917482 | 11/1982 | Germany . |
| 3644514 | 12/1988 | Germany . |
| 9203559 | 7/1992 | Germany . |
| 4142716 | 6/1993 | Germany . |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A switch for opening and closing an electrical circuit comprises a temperature-dependent switching mechanism and a housing containing a switching mechanism. The housing has an electrically conductive lower housing part and an electrically conductive cover part electrically insulated from and closing off the lower housing part. The electrical circuit is to be connected to the lower housing part and the cover part. As a function of temperature the switching mechanism electrically connects the lower housing part to the cover part. At least one resistor is provided directly on an inner surface of the housing such that the resistor is switched in series with the switching mechanism between the cover part and lower housing part, as a function of temperature, when the switching mechanism is in a first switch position.

14 Claims, 1 Drawing Sheet

SWITCH HAVING A TEMPERATURE-DEPENDENT SWITCHING MECHANISM

BACKGROUND OF THE INVENTION

1. Field of the Invention

The present invention relates to a switch for opening and/or closing an electrical circuit, having a temperature-dependent switching mechanism and a housing, receiving the switching mechanism, which has an electrically conductive lower part as well as an electrically conductive cover part, closing off the latter, that is electrically insulated from the lower part, such that the switching mechanism, as a function of its temperature, creates an electrical connection between the cover part and the lower part, and the electrical circuit can be connected on the one hand to the cover part and on the other hand to the lower part.

2. Description of Related Art

A switch of this kind is known from DE 29 17 482 C2.

In the case of the known switch a metal housing is provided, the lower part being insulated from the cover part by interposition of an insulating film. The cover part is mounted in lossproof fashion onto the lower part by means of a crimped rim of the latter. Provided in the interior of the housing is a temperature-dependent bimetallic switching mechanism which comprises a spring disk that carries a movable contact element. A bimetallic snap disk is slipped over the contact element.

Below the response temperature of the bimetallic snap disk, the spring disk presses the movable contact element against a projection provided on the inside of the cover part, and on the other hand is braced at its rim against the inside of the lower part. Since the spring disk is made of electrically conductive material, an electrical connection is thus created between the cover part and the lower part.

If the temperature of the switch is then raised, the bimetallic snap disk then snaps over, is now braced at its rim against the inside of the cover part, and pushes the movable contact element away from the cover part against the force of the spring disk. Since the insulating film covers a large part of the inside of the cover part, the rim of the bimetallic disk, now being braced against the cover part, is insulated with respect to the cover part, so that after the contact element lifts away from the projection the electrically conductive connection between the cover part and the lower part is interrupted.

Switches of this kind are connected in series with an electrical load in an electrical circuit, provision being made for a good thermal connection between the electrical switch and the load being protected. As a result of the functional principle of the bimetallic switching mechanism as described above, the load is supplied with power as long as its temperature is low enough that the response temperature of the bimetallic snap disk is not reached. If the temperature of the load rises above a permissible value because of an operational malfunction, the electrical circuit is interrupted and the load is thus deactivated for protection from overtemperature.

The known switch with its encapsulated metal housing is very robust and insensitive to mechanical influences, so that it satisfactorily meets the demands made upon it.

A disadvantage of this switch, however, is the fact that it automatically reactivates when the load cools down, so that repeated activation and deactivation of the load occurs if the malfunction is not corrected after the first deactivation. Cycling switching behavior of this kind is, however, often undesirable.

In order to remedy this drawback, a further switch that comprises a lower part which is closed off by a cover part made of thermistor material and in which the switching material is arranged, is known from EP 0 2 84 916 A2. The bimetallic switching mechanism comprises, in known fashion, a bimetallic snap disk as well as a spring disk on which a movable contact element is held. Below the response temperature of the bimetallic snap disk, the movable contact element is pressed by the spring disk against a fixed contact element that is provided on the cover part, extends through the cover part in the manner of a rivet, and transitions externally into a head. The lower part is made of electrically conductive material, so that at low temperatures a conductive connection is created between the lower part and the head of the fixed contact element. The cover part is conductively connected both to the fixed contact element and to the lower part, so that it is connected electrically in parallel with the switching mechanism.

When the switching mechanism then opens as a result of excessive temperature, current thus flows from the fixed contact element, through the PTC thermistor constituting the cover part, to the lower part, thus causing the PTC thermistor to heat up and hold the switching mechanism open, even if the overtemperature triggering the switching action is no longer present. The PTC thermistor thus acts to provide a self-holding function.

In a further embodiment from this document, the cover part comprises a ceramic support part on which is arranged a carbon resistor which, as a heating resistor, provides the self-hold function.

If the cover part is made of thermistor material, it does not have the requisite compression stability often required by the known switches in rough everyday use. Switches of this kind are used for temperature monitoring of motors, heating coils, etc., so they are often exposed to severe mechanical stresses as a result of the vibrations associated with operation of the loads being protected. Severe pressures can also be exerted on the cover of the temperature controller.

If the parallel resistor is a carbon resistor, the cover itself can be made of a mechanically more stable material, but just as with the cover part made of thermistor material, a through contact outward through the cover is necessary, which is not required in the case of the switch discussed at the outset.

The switch known from EP 0 284 916 A2 thus has the advantage over the switch mentioned at the outset that it is equipped with a self-hold function, but on the other hand has other disadvantages consisting of complex design and reduced mechanical strength.

Lastly, DE 43 36 564 A1 discloses a further self-holding switch having a PTC thermistor connected in parallel, a further heating resistor being connected in series with the switching mechanism and providing overcurrent sensitivity for the known switch.

This switch comprises a ceramic support plate, equipped with conducting and insulating coatings, on which is arranged an encapsulated bimetallic switching mechanism next to which sits the thermistor module, which is connected electrically in parallel with the switching mechanism. Also arranged on the ceramic support plate is a thick-film resistor that passes beneath the switching mechanism and is connected in series with it.

The known switch is also connected in series with a load being protected, so that the operating current of that load flows through it. At the same time this switch is thermally connected, in a known manner, with the load being protected. If the operating current of the load increases impermissibly due to a defect, the thick-film resistor, connected in series, heats up the switching mechanism to the extent that it opens, so that the PTC thermistor, connected in parallel, accepts the current. Because of the high resistance of the PTC thermistor, the operating current of the load then decreases to a harmless level which is nevertheless sufficient, by way of the ohmic loss in the PTC thermistor, to maintain a temperature which holds the switching mechanism open.

Of course this switch will also open when the temperature of the load being protected is too high; here again, the PTC thermistor provides for self-holding of the switching mechanism, which is now open.

A disadvantage of this switch is that its construction is relatively cumbersome and large, a fact attributable in particular to the ceramic support plate.

More stringent safety requirements as well as new safety regulations make it necessary for the switch mentioned initially, which is often also referred to as a temperature controller, to be equipped with a self-hold function and/or with overcurrent sensitivity. The known switches described above, however, which have such functions, are not satisfactory in terms of mechanism and construction, their high production costs being particularly disadvantageous.

SUMMARY OF THE INVENTION

In view of the above, it is an object of the present invention to improve the switch mentioned at the outset in such a way that it can be equipped, by means of a simple design, alternatively with a self-hold function and/or overcurrent sensitivity; the new switch is furthermore intended to be economical to produce.

According to the invention this object is achieved, in the case of the switch discussed at the outset, by the fact that at least one resistor, which when the switching mechanism is in one switch position is switched in series with the latter between the cover part and lower part, is arranged directly on the inside of the housing.

The underlying object of the invention is completely achieved in this manner. Specifically, the inventor of the present application has recognized that, surprisingly, it is possible to apply a resistor directly onto the inside of the electrically conductive cover part or onto the electrically conductive lower part, and thereby to provide the necessary resistance for the self-hold function and/or for overcurrent sensitivity.

If this resistor is arranged so that it is connected in series with the switching mechanism when the latter is below the response temperature, the resistor then provides current sensitivity for the new switch. The resistor in this case should have a value between ca. 50 milliohms and 30 ohms. This can be achieved, for example, by means of bismuth ruthenate, which can be applied onto the cover part or the lower part using the screen printing process.

If, however, the resistor is connected in series with the switching mechanism when the latter is above its response temperature, i.e. has opened the electrical circuit, it then provides a self-hold function. In this case the resistance should be ca. 10 to 100 kilohms, which can be achieved, for example, by means of barium titanate, which can be bonded on with conductive adhesive or "sputtered" on by cathodic sputtering.

All of the mechanical advantages furnished by the generic switch can thus be retained, while in order to achieve the self-hold function and/or overcurrent sensitivity, a suitably dimensioned resistor layer simply needs to be applied at an appropriate point on the inside of the cover part or lower part. Thus only one further production step is required in order to impart to the known switch the desired additional safety function. Compared with the known switches discussed in more detail above, the design is thus considerably simplified, being moreover associated with very low additional production costs. In the series production process in which the generic switch is manufactured, implementing the additional safety functions then involves simply replacing the cover part and/or the lower part. Since one or indeed both of these safety functions are not necessary for every application, during the aforementioned series production of the generic switch, a switch having overcurrent sensitivity or a switch having self-hold function can be produced as required, resulting in a kind of modular principle which, of course, greatly reduces overall production costs.

In an embodiment, it is preferred if a further resistor, which when the switching mechanism is in a different switch position is switched in series with the latter between the cover part and lower part, is arranged directly on the inside of the housing.

The advantage here is that now a resistor is switched in series with the switching mechanism between cover part and lower part with the switching mechanism in both switch positions, so that provision is made in the one switch position for a self-hold function, and in the other switch position for overcurrent sensitivity of the new switch.

It is preferable in general in this context if the switching mechanism comprises a movable contact element which is carried by an electrically conductive spring disk that can be moved by a bimetallic snap disk, and which when the switching mechanism is in a first switch position is in contact with a contact region on the inside of the cover part, the spring disk being braced at its rim against a contact region of the lower part.

The advantage here is that the switching mechanism known per se can also be used in the case of the new switch, so that no additional design measures are required in order to produce the new switch. This again appreciably reduces costs.

It is further preferred if, when the switching mechanism is in a second switch position, the contact element is in contact with a further contact region on the inside of the lower part, and the spring disk is in contact at its rim with a further contact region on the cover part.

The advantage here is that an alternating switch, so to speak, is made available, which can nevertheless use the known switching mechanism. In the case of the generic switch all that is necessary for this purpose is to apply the insulating film in such a way that the cover part is no longer insulated on its inner side with respect to the interior of the housing, i.e. with respect to the rim of the bimetallic snap disk and/or the spring disk. The known switching mechanism thus connects the cover part and lower part firstly by the fact that the movable contact element contacts the cover part, and the rim of the spring disk contacts the lower part; while in the other switch position the movable contact element contacts the lower part, and the rim of the spring disk, optionally with the rim of the bimetallic snap disk interposed, contacts the inside of the cover part. A very simple alternating switch, in which the individual resistors can now be arranged, as needed, appropriately on the inner sides of the cover part and lower part, is thus created.

The resistor can, for example, be configured as a disk and then arranged in the contact regions of the movable contact element on the cover part or the lower part. On the other hand it is possible to configure the resistor as a ring, and thus arrange it at the contact regions for the rim of the spring disk on the inside of the cover part or the lower part. Other geometries, for example meander or spiral shapes, are also conceivable with regard to setting the resistance value.

Depending on the desired function of these resistors, the resistance values must be set as described above by way of the geometrical dimensions of the resistor and the specific resistance of the resistor material, based on the known relationship.

Further advantages are evident from the description and the attached drawings.

It is understood that the features mentioned above and those yet to be explained below can be used not only in the respective combinations indicated, but also in other combinations or in isolation, without leaving the context of the present invention.

BRIEF DESCRIPTION OF THE DRAWING

An exemplified embodiment of the invention is shown in the drawings and explained further in the description below.

The single FIGURE shows a schematic illustration of the new switch in longitudinal section.

DETAILED DESCRIPTION OF A PREFERRED EMBODIMENT

Figure 1:
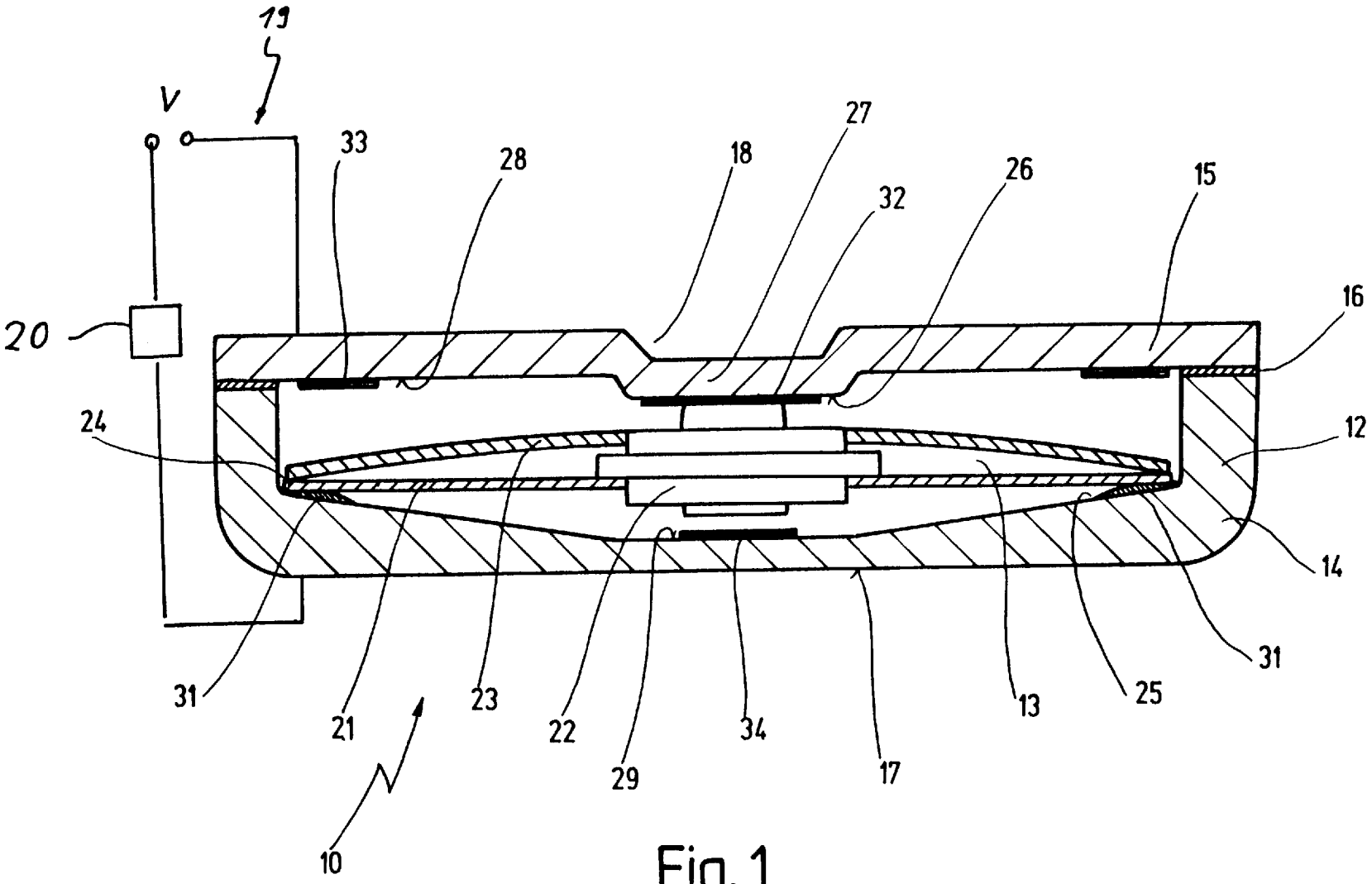

In the single FIGURE, 10 designates a switch which comprises a housing 12 in which a temperature-dependent switching mechanism 13 is arranged. Housing 12 comprises a lower part 14 made of electrically conductive material, as well as a cover part 15, also electrically conductive, that is electrically insulated with respect to lower part 14 by an insulating ring 16. Mechanical cohesion between lower part 14, cover part 15, and insulating ring 16 can be effected, for example, by means of a crimped rim (not shown for reasons of clarity), by adhesive bonding, by clamping, or by other suitable measures. This mechanical fastening does not, however, play an important role in the present invention. For further information in this connection, the reader is referred to the printed documents mentioned above.

Switch 10 is connected, via its underside 17 and a snap recess 18 on cover part 15, to an electrical circuit 19 in which it is connected in series with a load 20 being protected.

Bimetallic switching mechanism 13 comprises a spring disk 21 which bears a movable contact element 22. A bimetallic snap disk 23 is slipped over movable contact element 22. In the switch position shown in FIG. 1, the bimetallic snap disk is below its response temperature.

In this switch position, spring disk 21 is braced at its rim 24 against a contact region 25 on the inside of lower part 14, and presses movable contact element 22 against a contact region 26 that is provided on the inside of a projection 27 of cover part 15. This projection 27 corresponds to snap recess 18 on the outside of cover part 15.

In the switch position shown, a current flows from cover part 15, via movable contact element 22 and spring disk 21, to lower part 14.

If the temperature of the switch and thus of bimetallic snap disk 23 then rises above its response temperature, bimetallic snap disk 23 transitions from the convex shape shown into a concave shape, braces itself against a further contact region 28 on the inside of cover part 15, and then pushes movable contact 22 away from contact region 15 against the force of spring disk 21.

Switching mechanism 13 then ultimately arrives in its second switching state, in which movable contact element 22 is braced at the bottom against lower part 14 at a further contact region 29, while rim 24 of spring disk 21, optionally with bimetallic snap disk 23 interposed, is now in contact with contact region 28. An electrically conductive connection is thereby created once again between cover part 15 and lower part 14. Switch 10 thus operates as an alternating switch.

In order now to impart overcurrent sensitivity and/or a self-hold function to switch 10, resistors can be alternatively applied onto contact regions 25, 26, 28, 29. In FIG. 1, a ring resistor 31 is arranged on contact region 25, a disk resistor 32 on contact region 26, a further ring resistor 33 on contact region 28, and a further disk resistor 34 on contact region 29. Thus with switching mechanism 13 in the idle position shown in FIG. 1, disk resistor 32 and ring resistor 31 are connected in series with switching mechanism 13 between cover part 15 and lower part 14, thus implementing overcurrent sensitivity for the new switch.

When switching mechanism 13 is in the other switch position (not shown), disk resistor 34 and ring resistor 33 are now in series with switching mechanism 13 between cover part 15 and lower part 14, thus providing a self-hold function.

Of course it is not necessary to configure all four resistors 31, 32, 33, 34 in the case of the new switch. It may be sufficient, for example, to provide only resistors 32 and 33 on cover part 15, or only resistors 31 and 34 on lower part 14.

This therefore makes possible a kind of modular principle, in which, depending on the safety function desired, for example lower part 14 remains unchanged while cover part 15 is equipped with one or both of resistors 32 and 33. On the other hand it is of course also possible to configure cover part 15 without resistors, and to equip lower part 14 with one or both of resistors 31 and 34 depending on the safety function desired.

In selecting the values of resistors 31, 32, 33, 34, the safety functions to be made available by them must of course be taken into consideration.

Disk resistor 32 on cover part 15 that is "responsible" for the overcurrent sensitivity is made, for example, of bismuth ruthenate, and has a diameter of 1.5 mm and a film thickness of 0.05 mm, resulting in a resistance value of ca. 4 ohms, which is suitable for overcurrent sensitivity. Ring resistor 31, on the other hand, which is also made of bismuth ruthenate, can have an outside diameter of 9 mm and an inside diameter of 8 mm, so that with a thickness of 0.05 mm it exhibits a total resistance of 0.5 ohms, which also provides overcurrent sensitivity.

Disk resistor 29 responsible for self-holding is made, for example, of barium titanate, and is a round disk having a thickness of 1 mm that is bonded on with conductive adhesive. Alternatively, for example, conductive plastic can also be used.

The resistance of disk resistor 29 is set, in accordance with known geometrical relationships, in such a way that it is between 10 and 100 kilohms when hot. A corresponding resistance value can also be achieved by suitable dimensioning of ring resistor 28. It is also possible to sputter on barium titanate or a comparable PTC semiconductor by cathodic sputtering.

It should also be noted that, for example, ruthenium oxide or Ag—Pd—Ag oxide can also be used as resistor material in place of bismuth ruthenate.

I claim:

1. A switch for opening and closing an electrical circuit, comprising:

a temperature-dependent switching mechanism; and a housing containing said switching mechanism, said housing having an electrically conductive lower housing part and an electrically conductive cover part electrically insulated from and closing off said lower housing part, the electrical circuit to be connected to the lower housing part and the cover part;

said switching mechanism electrically connecting said lower housing part to said cover part by a movable contact carrying on an electrically conductive spring disk as a function of temperature, wherein at least one resistor is provided directly on an inner surface of said housing, such that said at least one resistor is switched in series with said switching mechanism between the cover part and lower housing part, as a function of temperature, when said switching mechanism is in a first switch position.

2. The switch of claim 1, wherein a further resistor is provided directly on a further inner surface of said housing such that said further resistor is switched in series with said switching mechanism between the cover part and lower housing part, as a function of temperature, when said switching mechanism is in a second switch position.

3. The switch of claim 1, wherein the switching mechanism comprises a bimetallic snap disk acting against said spring disk, said movable contact being in contact with a first contact region of the cover part when the switching mechanism is in said first switch position, the spring disk being braced at its rim against a second contact region of the lower part.

4. The switch of claim 3, wherein the resistor is arranged on the first contact region of said cover part.

5. The switch of claim 3, wherein the further resistor is provided on the second contact region of the lower part.

6. The switch of claim 3, wherein a third contact region is provided on the lower housing part and a fourth contact region is provided on the cover part, the movable contact element being in contact with said third contact region and the spring disk being in contact at its rim with the fourth contact region, when the switching mechanism is in the second switch position.

7. The switch of claim 6, wherein the further resistor is arranged on the third contact region of the cover part.

8. The switch of claim 6, wherein the further resistor is arranged on the fourth contact region of the lower housing part.

9. The switch of claim 2, wherein said resistor and said further resistor are arranged on an inner surface of the cover part.

10. The switch of claim 2, wherein said resistor and said further resistor are arranged on an inner surface of the lower housing part.

11. The switch of claim 6, wherein the resistor is configured as a ring and is applied onto the fourth contact region of the cover part.

12. The switch of claim 6, wherein the resistor is configured as a ring and is applied onto the second contact region of the lower housing part.

13. The switch of claim 12, wherein the resistor is applied using a screen printing process.

14. The switch of claim 1, wherein the resistor is applied by cathodic sputtering.

* * * * *